US006236819B1

(12) United States Patent
Kim

(10) Patent No.: US 6,236,819 B1
(45) Date of Patent: May 22, 2001

(54) PRINTER CAPABLE OF RETURNING TO A RESET STATE EVEN IF EXTERNAL POWER IS INTERRUPTED

(75) Inventor: Min-seon Kim, Suwon (KR)

(73) Assignee: Samsung Electronics Co., Ltd., Kyungki-Do (KR)

( * ) Notice: Subject to any disclaimer, the term of this patent is extended or adjusted under 35 U.S.C. 154(b) by 0 days.

(21) Appl. No.: 09/342,727

(22) Filed: Jun. 29, 1999

(30) Foreign Application Priority Data

Jun. 29, 1998 (KR) ..... 98-24984

(51) Int. Cl.[7] ..... G03G 15/00
(52) U.S. Cl. ..... 399/88; 307/64; 307/66
(58) Field of Search ..... 399/88, 37, 75, 399/9, 18, 19; 307/64, 66, 112, 113, 116; 363/52, 53

(56) References Cited

U.S. PATENT DOCUMENTS 4,569,585 * 2/1986 Masuda ..... 399/37
4,771,312 * 9/1988 Yanase et al. ..... 399/88

FOREIGN PATENT DOCUMENTS 52-13728 2/1977 (JP) .
62-296724 12/1987 (JP) .

OTHER PUBLICATIONS

Japanese Publication No. 05–236744 A (with English language Abstract) Sept.10, 1993.
Japanese Publication No. 05–77474 A (with English langauge Abstract) Mar. 30, 1993.
Japanese Publication No. 04–331428 A (with English Language Abstract) Nov. 19, 1992.
Japanese Publication No. 09–294330 A (with English language Abstract) Nov. 11, 1997.
Japanese Publication No. 64–62720 A (with English language Abstract) Mar. 9, 1989.

* cited by examiner

*Primary Examiner*—Arthur T. Grimley
*Assistant Examiner*—Hoan Tran
(74) *Attorney, Agent, or Firm*—Sughrue, Mion, Zinn, Macpeak & Seas, PLLC

(57) ABSTRACT

A printer including a power supply portion for converting power supplied from an external power source and supplying the same to the printer, a printer engine receiving power from the power supply portion through a power supply line, an auxiliary power storage portion for receiving power from the power supply portion to store auxiliary power, and supplying the auxiliary power necessary to drive the printer when the power supply from the external power source to the power supply portion is interrupted, a switching portion installed between the auxiliary power storage portion and the printer engine intermittently supplying power, and a printer controller for detecting a potential level of the power supply line and controlling the switching portion.

11 Claims, 2 Drawing Sheets

PRINTER CAPABLE OF RETURNING TO A RESET STATE EVEN IF EXTERNAL POWER IS INTERRUPTED

BACKGROUND OF THE INVENTION

1. Field of the Invention

The present invention relates to a printer, and more particularly, to a printer which can supply auxiliary power necessary for the same to return to a reset state even if external power supply is interrupted.

2. Description of the Related Art

FIG. 1 is a schematic diagram of a printer engine of a general liquid color printer. Referring to FIG. 1, a reset device 15, scanning units 16, development devices 17, a drying device 18 and a transfer device 20 are arranged around a photoreceptor belt 14 traveling along a plurality of rollers 11, 12 and 13.

In the operation of the printer, the scanning units 16 scan light onto the photoreceptor belt 14 traveling via the reset device 15 according to image signals to form a latent electrostatic image. The latent electrostatic image is developed by developer liquid delivered by the development devices 17. The thus-developed image contacts the photoreceptor belt 14 and is transferred to a rotating transfer roller 21 to then be carried to a sheet 23 moving between the transfer roller 21 and a pressing roller 22. The transfer roller 21 and the pressing roller 22 are heated at a predetermined temperature by a heater (not shown) incorporated in the printer.

While the printing operation is not performed, the transfer device 20, the drying device 18 and the development devices 17 are separated from the photoreceptor belt 14, to avoid transmission of heat from the transfer roller 21 and the pressing roller 22 to the photoreceptor belt 14 or damage to the photoreceptor belt due to being pressed by the transfer roller 21 and the development devices 17.

In the course of performing the printing operation, if external power supply is cut off due to an unexpected interruption of power supply, the printer immediately stops the printing operation in progress. In such a state, if the power interruption is continued for a long time, the photoreceptor belt 14 maintained in a pressed state by the transfer roller 21, a drying roller 18*a*, development rollers 17*a* may become damaged. Also, the developer liquid stuck to the photoreceptor belt 14 and the transfer roller 21 may be hardened to cause contamination on various parts of the printer.

SUMMARY OF THE INVENTION

To solve the above problems, it is an objective of the present invention to provide a printer which can supply auxiliary power to convert the printer engine thereof into a printing suspension mode even if external power supply is abruptly interrupted during a printing operation.

Accordingly, to achieve the above objective, there is provided a printer including a power supply portion for converting power supplied from an external power source and supplying the same to the printer, a printer engine receiving power from the power supply portion through a power supply line, an auxiliary power storage portion for receiving power from the power supply portion to store auxiliary power, and supplying the auxiliary power necessary to drive the printer when the power supply from the external power source to the power supply portion is interrupted, a switching portion installed between the auxiliary power storage portion and the printer engine, for intermittently supplying power, and a printer controller for detecting a potential level of the power supply line and controlling the switching portion.

The power supply portion includes a first port through which a voltage of +24 V is applied, and a second port through which a voltage of +5 V is applied, and the auxiliary power storage portion receives power from the first port and forms a +24 V-auxiliary voltage source and a first +5 V-auxiliary voltage source.

Also, the auxiliary power storage portion receives power from the second port and forms a second +5 V-auxiliary voltage source for applying a voltage of +5 V to the printer controller when the power supply from the power supply portion is interrupted.

BRIEF DESCRIPTION OF THE DRAWINGS

The above objective and advantages of the present invention will become more apparent by describing in detail a preferred embodiment thereof with reference to the attached drawings in which.

DESCRIPTION OF THE PREFERRED EMBODIMENTS

Figure 1:
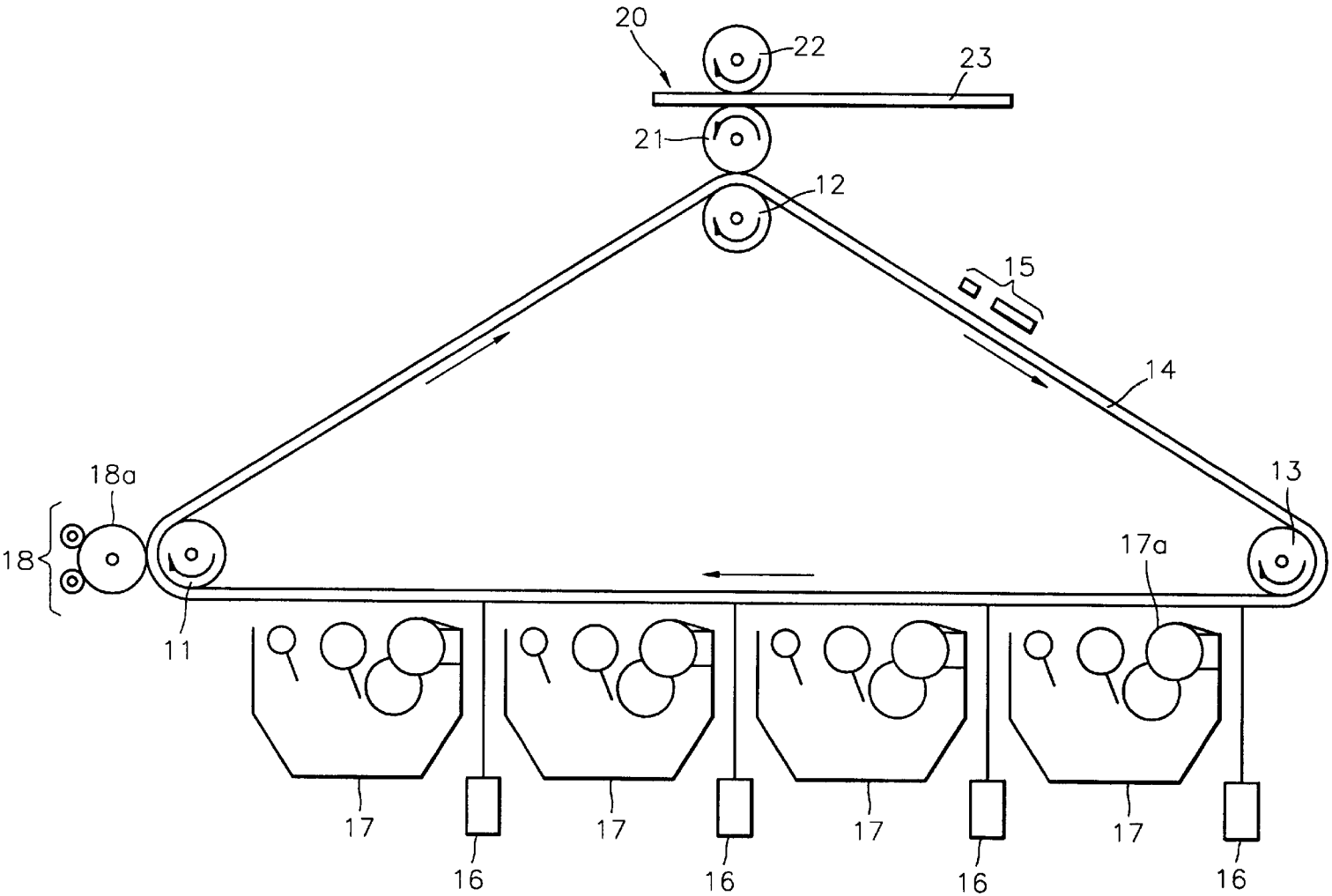
FIG. 1 (PRIOR ART)
FIG. 1 is a schematic diagram illustrating a printer engine of a general liquid printer.
Figure 2:
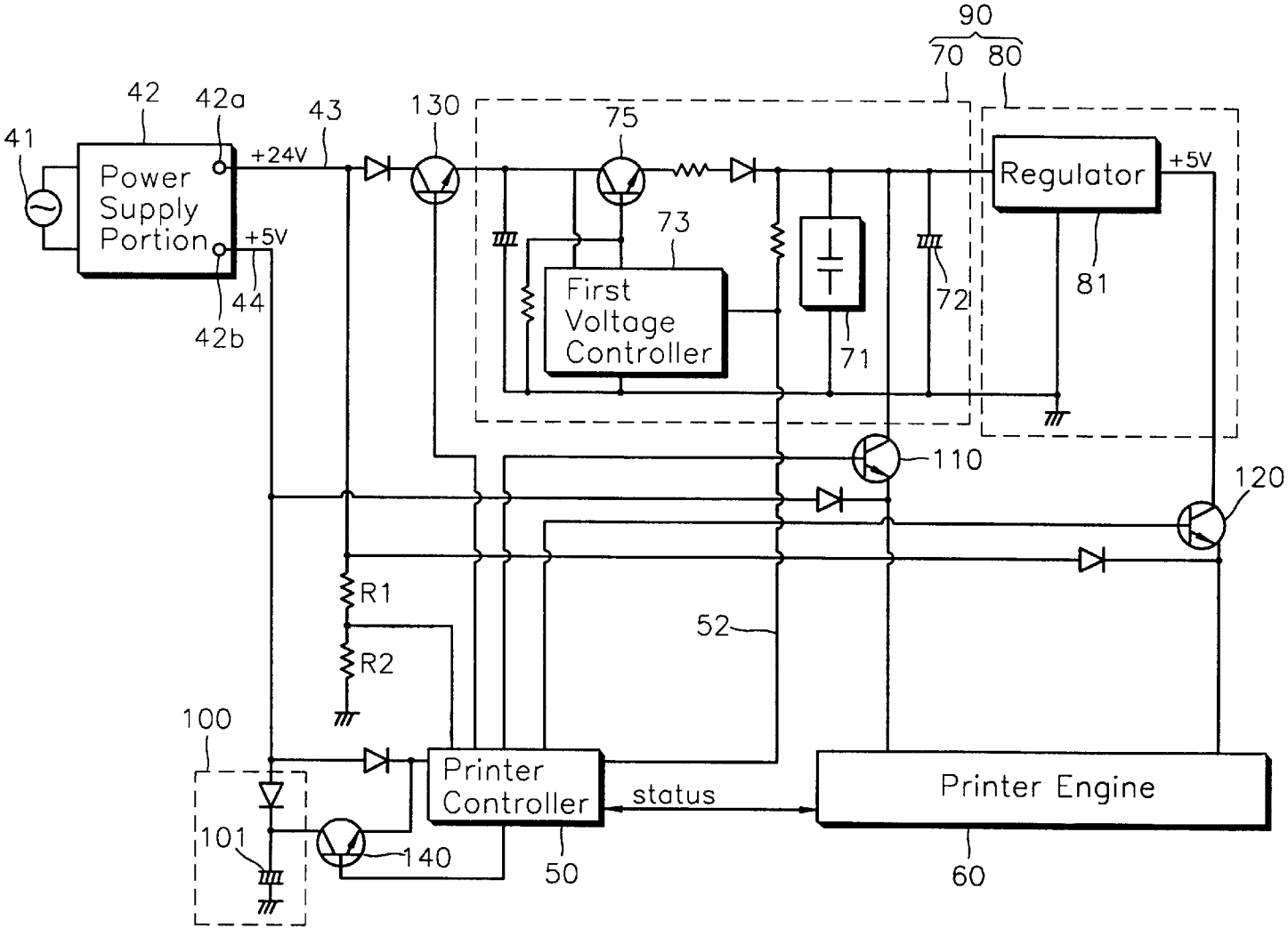
FIG. 2 is a circuit block diagram illustrating a printer according to the present invention.

Referring to FIG. 2 showing a printer according to the present invention, a power supply portion 42 converts power supplied from an external power source 41 which is a commercial AC power such as 110 Vac or 220 Vac and generates voltages necessary to drive a printer controller 50 and a printer engine 60, for example, +24 V and +5 V, from its first and second ports 42*a* and 42*b* through power supply lines 43 and 44. The voltages applied from the power supply portion 42 are appropriately determined according to the specifications of the printer controller 50 and the printer engine 60.

According to the present invention, there is provided an auxiliary power supply storage portion for supplying power to the printer controller 50 and the printer engine 60 during power interruption. The auxiliary power supply storage portion includes a first circuit unit 90 for the printer engine 60 and a second circuit unit 100 for the printer controller 50. The first circuit unit 90 generates auxiliary voltages of +24 V and +5 V, the second circuit unit 100 generates an auxiliary voltage of +5 V.

The first circuit unit 90 includes a +24 V-auxiliary power circuit unit 70 having a battery 71 connected to the first port 42*a*, for charging electrical energy having an electric potential of +24 V, and a capacitor 72, and a +5 V-auxiliary power circuit unit 80, for stepping-down the electric potential of the electrical energy charged in the battery 71 and the capacitor 72, to 5 V.

The +24 V-auxiliary power circuit unit 70 includes a first voltage controller 73, which turns on/off a switching element 75 installed along an electric wire between the first port 42*a* and the battery 71 so that the battery 71 is maintained at the electric potential of +24 V.

The +5 V-auxiliary power circuit unit 80 includes a regulator 81 for stepping-down the charged voltages of the battery 71 and the capacitor 72 to +5 V.

The second circuit unit 100 charges the capacitor 101 with the power supplied from the second port 42*b* and supplies the power to the printer controller 50. Alternatively, although not shown, the circuitry may be constructed such that auxiliary power is supplied from the +5 V-auxiliary power circuit unit 80 to the printer controller 50, with the second circuit unit 100 omitted.

A switching unit includes two switching elements 110 and 120 installed to intermittently supply power from the battery 71 to the capacitor 72, and from the regulator 81 to the printer engine 60. Also, a switching element 130 is installed between the first port 42*a* and the first circuit unit 90, and a switching element 140 is installed between the second circuit unit 100 and the printer controller 50. The on/off state of the switching elements 110, 120, 130 and 140 is controlled by the printer controller 50.

Two resistor elements R1 and R2 connected to the power supply line 43 of the first port 42*a* serve as a voltage distributor. The resistor R2 is connected to the printer controller 50 to indicate a power failure. The printer controller 50 is connected to one end of the battery 71 so as to obtain information on a charged potential level of the battery 71.

In the operation of the printer having the aforementioned configuration, when power is supplied from the external power source 41 to the power supply portion 42, the printer controller 50 turns on the switching element 130 so that the electrical energy is charged in the battery 71 and the capacitor 72. The printer controller 50 turns off the switching element 130 when it is detected through a potential detection line 52 that the potential of the battery 71 reaches +24 V. Here, with the electrical energy charged in the first circuit unit 90, the printer engine 60 and the printer controller 50 receive power from the first and second ports 42*a* and 42*b* through the supply lines 43 and 44 to perform a printing operation.

When power supply from the external power source 41 to the power supply portion 42 is cut off, the voltage of the resistor element R2 is dropped. Accordingly, the printer controller 50 turns on the switching element 140 so that it receives driving power through the capacitor 101 of the second circuit unit 100. Also, the printer controller 50 detects the information concerning the operating state of the printer, and, if a printing mode is detected, turns on the switching elements 110 and 120 so that power continues to supply to the printer engine 60. Simultaneously, the printer controller 50 outputs a signal for converting the mode into a printing suspension mode to the printer engine 60. Accordingly, the printer engine 60 returns the peripheral devices such as a transfer device, a drying device or development devices to their reset states such that they are separated apart from the photoreceptor belt and then stops the printing operations.

As described above, according to the printer of the present invention, even if power from an external power source is interrupted during a printing operation, auxiliary power is supplied to the printer so that the mode of the printer is converted into a printing suspension mode, thereby preventing damage to the printer due to abrupt suspension of operation.

What is claimed is:

1. A printer comprising:

a power supply portion for converting power supplied from an external power source and supplying the same to the printer;

a printer engine receiving power from the power supply portion through a power supply line;

an auxiliary power storage portion for receiving power from the power supply portion to store auxiliary power, and supplying the auxiliary power necessary to drive the printer when the power supply from the external power source to the power supply portion is interrupted;

a switching portion installed between the auxiliary power storage portion and the printer engine, for intermittently supplying power; and a printer controller for detecting a potential level of the power supply line and controlling the switching portion.

2. The printer according to claim 1, wherein the power supply portion includes a first port through which a voltage of +24 V is applied, and a second port through which a voltage of +5 V is applied, and the auxiliary power storage portion receives power from the first port and forms a +24 V-auxiliary voltage source and a first +5 V-auxiliary voltage source.

3. The printer according to claim 2, wherein the first +5 V-auxiliary voltage source steps-down the power supplied from the +24 V-auxiliary voltage source.

4. The printer according to claim 2, wherein the auxiliary power storage portion receives power from the second port and forms a second +5 V-auxiliary voltage source for applying a voltage of +5 V to the printer controller when the power supply from the power supply portion is interrupted.

5. The printer according to claim 4, wherein a switching element for intermittently supplying power is provided between the second +5 V-auxiliary voltage source and the printer controller and the on/off state of the switching element is controlled by the printer controller.

6. The printer according to claim 4, wherein the second +5V-auxiliary voltage source comprises a second capacitor having a first terminal connected to the printer controller and the second port, and having a second terminal connected to ground.

7. The printer according to claim 2, wherein a switching element for intermittently supplying power between the power supply portion and the auxiliary power storage portion is provided, and the printer controller detects a potential level of the +24 V-auxiliary voltage source and controls the on/off state of the switching element.

8. The printer according to claim 2, wherein the +24V-auxiliary voltage source comprises:

a battery connected to the first port; and a capacitor connected to the battery in parallel.

9. The printer according to claim 1, wherein the auxiliary power storage portion comprises:

a battery connected to the power storage portion; and a first capacitor connected to the battery in parallel.

10. The printer according to claim 1, wherein the switching portion includes a transistor having an on/off state controlled by the switching portion.

11. The printer according to claim 1, wherein the printer controller judges when the power supply from the external power source to the power supply portion is interrupted based on the potential level of the power supply line; and the printer controller controls the switching portion to supply power from the auxiliary power storage portion to the printer engine upon judging that the power supply from the external power source to the power supply portion has been interrupted.

* * * * *